US006691532B2

(12) United States Patent
Stringer et al.

(10) Patent No.: US 6,691,532 B2
(45) Date of Patent: Feb. 17, 2004

(54) AIR SEPARATION UNITS

(75) Inventors: Thomas R. Stringer, Stirling, NJ (US); Joseph Paul Naumovitz, Lebanon, NJ (US); Alexander Edmiston, Hoboken, NJ (US); Ramachandran Krishnamurthy, Chestnut Ridge, NY (US); Mark J. Andrecovich, Somerville, NJ (US); Joseph Patriarca, Edison, NJ (US)

(73) Assignee: The BOC Group, Inc., Murray Hill, NJ (US)

( * ) Notice: Subject to any disclaimer, the term of this patent is extended or adjusted under 35 U.S.C. 154(b) by 68 days.

(21) Appl. No.: 10/054,232

(22) Filed: Nov. 13, 2001

(65) Prior Publication Data

US 2003/0089126 A1 May 15, 2003

(51) Int. Cl.[7] ..... F25J 3/00; F25J 3/02
(52) U.S. Cl. ..... 62/617; 62/298; 62/643
(58) Field of Search ..... 62/646, 911, 905, 62/617, 298

(56) References Cited

U.S. PATENT DOCUMENTS 5,349,827 A 9/1994 Bracque et al. ..... 62/298
5,461,871 A * 10/1995 Bracque et al. ..... 62/299
5,896,755 A * 4/1999 Wong et al. ..... 62/643
5,912,425 A 6/1999 Peyron et al. ..... 96/109
6,128,921 A 10/2000 Guillard et al. ..... 62/643
6,148,637 A 11/2000 Guillard et al. ..... 62/643
6,202,305 B1 3/2001 Bracque et al. ..... 29/897
6,205,815 B1 * 3/2001 Bruder et al. ..... 62/643
6,272,883 B2 * 8/2001 Bruder et al. ..... 62/643

FOREIGN PATENT DOCUMENTS

EP 0870524 10/1998 ..... B01D/3/14
EP 0913653 4/1999 ..... F25J/3/04

OTHER PUBLICATIONS

"The Power of Product Platforms", by Meyer, M. H. et al., *The Free Press*, pp. 15–20, 39–51, 119–121.
Declaration of Thomas A. Stringer with accompanying Exhibit 1 and Exhibit 2.

* cited by examiner

*Primary Examiner*—William C. Doerrler
(74) *Attorney, Agent, or Firm*—Philip H. Von Neida; Salvatore P. Pace

(57) ABSTRACT

Air separation units are designed and constructed by selecting two or more modules from libraries containing different module designs. Each library comprises at least two modules with standardized interface point layouts. The standardization of interface points for each module in a given library allows for module interchangeabilty and flexibility in the design and construction of air separation units.

18 Claims, 4 Drawing Sheets

AIR SEPARATION UNITS

FIELD OF THE INVENTION

This invention relates generally to air separation units, and more particularly, to a method of designing or building air separation units by using libraries containing different module designs, and to air separation units constructed according to such a method.

BACKGROUND OF THE INVENTION

FIG. 1 is a schematic illustration of a portion of an air separation plant or unit 10 for the production of oxygen, nitrogen and/or argon. A main air compressor (MAC) 11 is used to produce a compressed air stream, e.g., at a pressure of 5–6 atmospheres, which is fed to pre-purification units (PPU) 12*a–b* in which carbon dioxide, water, trace hydrocarbons and other condensable substances are removed.

The air leaving the PPU 12*a–b* is then split into two streams. A main air stream 13*a*, comprising between about 40% to about 80% of the air volume leaving the PPU, is fed to main heat exchanger (MHE) 14. Second stream 13*b* is passed to booster compressor 15 to produce a boosted air stream 13*c* having a pressure of about 10–70 atmospheres. The split ratio between the main air stream and the boosted air stream is a factor of a number of variables not the least of which is the desired product mix of the air separation plant. The boosted air is also fed to the MHE.

The MHE internals are of standard design, and the MHE is operated in standard fashion. The main air exits the MHE as saturated vaporous main air stream 13*d* at a temperature of about −187 C. (about −280 F.). The boosted air exits the MHE as liquid boosted air stream 13*e* at a temperature of less than about −187 C.

In certain air separation plant designs, main air side stream 13*f* is withdrawn from main air 13*a*, and passed through the MHE. The temperature of the main air side stream 13*f* is lowered within the MHE to about −140 C. (−220 F.), and it is withdrawn as vaporous main air side stream 13*g*. This side stream is then passed through expander 16 to lower its temperature to less than about −180 C. (−292 F.), and then fed as expanded main air side stream 13*h* directly into low pressure column 22.

Both the vaporous main air and liquid boosted air streams 13*d* and 13*e* are then fed to high pressure column (HPC) 17 at about −187 C. for separation into an oxygen-enriched liquid stream and a nitrogen-enriched product. The gaseous nitrogen product stream 32 may be withdrawn from the upper section of the HPC at about −200 C. (about −300 F.).

The HPC internals are of any standard construction, e.g., structured packing, distillation trays, etc., and the HPC is operated in a conventional fashion. An oxygen-rich liquid (RL) stream 18 is withdrawn from the lower section of the HPC 17, and comprises about 30–45% by volume oxygen, with the remainder being nitrogen, argon and residual air components such as xenon, krypton, and so on. Poor liquid (PL) stream 29 comprising essentially nitrogen, with various residual air components such as neon, etc., is withdrawn from the top section of the HPC 17. The split of these two liquid streams 18 and 29 is typically 55% by volume (or mole %) rich liquid and 45% by volume (or mole %) poor liquid. Both the rich and the poor liquid streams 18 and 29 are fed separately to subcooler 20, which is a refrigeration recovery heat exchange unit.

The resulting subcooled streams 21*a–b* are fed to low pressure column (LPC) 22, which is typically located above and is thermally coupled with the HPC 17. These subcooled streams enter the LPC 22 at a temperature of about −207 C. (about −316 F.) and at a pressure of between about 1 and 2 atmospheres. At this temperature and pressure, liquid oxygen 23*a* collects at the bottom of the LPC 22 from where liquid oxygen product stream 23*b* is withdrawn. The purity of the liquid oxygen product stream can vary from about 95% or less oxygen (low purity oxygen) up to and in excess of 99.9% oxygen (high purity oxygen). The actual purity or composition of the liquid oxygen stream depends in large part upon the manner in which other parts of the air separation plant are operated. If desired, another liquid stream 30 (also known as "intermediate liquid" stream) may be withdrawn from the HPC 17 and fed to the LPC 22 as an additional reflux stream.

Liquid oxygen generated in the lower section of the LPC 22 passes to the reboiler-condenser (R-C) 26, a portion of which is submerged within liquid oxygen in sump 23*a*. Gaseous nitrogen 27*a* from the HPC 17 is condensed in R-C 26 by indirect heat exchange with liquid oxygen in sump 23*a*, resulting in partially reboiling of the liquid oxygen. The condensed nitrogen stream 27*b* from R-C 26 enters the HPC 17. A poor liquid stream 29 is withdrawn from the HPC 17 and is passed to subcooler 20. This poor liquid stream can be withdrawn either from the same point as nitrogen stream 27*b* or it may be withdrawn several stages below the nitrogen stream 27*b* feedpoint.

The liquid oxygen product stream 23*b* withdrawn from the sump 23*a* at a pressure of about 1 atmosphere can be transferred either directly, or optionally via subcooler 20, to a liquid oxygen (LOX) storage tank 32, and optionally, via subcooler 20. If desired, oxygen can be withdrawn from the LOX storage tank 32, and pressurized to about 5–70 atmospheres by a liquid oxygen pump P24. The pressurized LOX product stream then exchanges heat with the main and boosted air streams 13*a* and 13*c* in the MHE 14, resulting in the formation of gaseous oxygen product stream 23*c*, which is recovered at a pressure of about 5–70 atmospheres.

Gaseous nitrogen waste stream 25*a* from the upper section of the LPC 22 is returned to the subcooler 20 for heat exchange with the rich and poor liquid streams from the HPC 17, and then discharged from the air separation unit after additional heat exchange with the main and boosted air streams in the MHE 14. Optionally, a product nitrogen stream (not shown) may also be withdrawn from the LPC 22 and recovered as a nitrogen product after undergoing heat exchange in subcooler 20 and MHE 14.

Aside from the configuration shown in FIG. 1, many other variations are also possible. Depending on the capacity requirement, different designs for the MHE is available with a different number of heat exchanger cores, e.g., 2–10 or more cores. If argon product is desired, then another distillation column may be coupled to the LPC 22 for additional processing of a fluid stream withdrawn from LPC 22. Moreover, the columns, compressors, expanders and other equipment can be arranged differently from that shown in FIG. 1, depending upon the refrigeration requirements of the plant. Labels A-N represent interface connections that will be addressed in conjunction with the discussion of FIG. 4.

Applications requiring smaller quantities, e.g., less than 200 metric tons per day (MTPD), of oxygen or nitrogen will usually require only one product and the specifications for that product (e.g., purity, pressure, flows, etc.) are well known. The commercial solution for these applications is typically building a small pre-fabricated plant, e.g., a nitrogen generator, and installing it on the customer's site (known as an "on-site application"). The economic drivers for plants of this nature are low cost, repeatability, small "footprint" and the like. These plants are highly standardized, and all major air separation unit suppliers have plants of this nature in one form or another.

Applications requiring larger quantities of gas, e.g., 200–2000 or more MTPD, sometimes require more than one product and the specifications for these products vary significantly. The commercial solution for these applications typically is a scheme in which large quantities of the desired gas are piped "over the fence" from a production facility located next to the customer's plant. In this way, the delivered gas is metered in much the same way as any other utilities (e.g., electricity, natural gas, water, etc.). The economic drivers for solutions to these plants include low evaluated cost, i.e., capital and power, robustness of the design, minimized footprint, and the like. These requirements are usually met by either repeating an existing plant design with specifications similar to those desired, or engineering a new design specific to the needs of the given application (known as a "custom" or "engineered-to-order" plant).

All air separation plant suppliers use variants of these two approaches to achieve an economical solution for a given application. If a repeat design is available, then that design is generally the best solution since the engineering effort does not require duplication (almost by definition, only minimal adjustments are required). However, rarely is a repeat design available because, for larger plants at least, the specifications and economic drivers usually differ significantly from plant to plant.

In those situations in which a repeat design is not available, the plant supplier typically begins with an existing plant design that is closest to the required specifications and then modifies that design to fit the specifications. Although there may be relatively few changes to the fundamental designs of the plant, typically a large number of changes are required if only as a result of changes in size of various components of the plant. Moreover, any change (no matter how small) will have a significant impact on other parts of the plant, i.e., it creates a "domino" or "ripple" effect. In particular, the spatial coordinates of inlets and outlets to various components, e.g., columns and heat exchangers, can necessitate a complete redesign of all of the pipe-work, an onerous and time consuming task given the complexity of an air separation plant.

Of particular interest to the economic solution of air separation plants of this size, particularly of a size between about 200–2000 MTPD, is an approach with unique design features that achieve the benefits of standardization (e.g., repeatability, reduced risk, supplier leverage, etc.) while at the same time achieving the benefits of a customized design (e.g., better fit, better balance between power and capital cost optimization, etc.).

SUMMARY OF THE INVENTION

One aspect of the invention provides for a method of designing an air separation unit. The method involves selecting a first module from a first library containing at least two different designs of the first module, selecting a second module from a second module library containing at least two different designs of the second module. Each of the module designs in the first library has a first set of interface points with substantially the same relative spatial coordinates as every other design in that library, and each of the module designs in the second library has a second set of interface points with substantially the same relative spatial coordinates as every other design in the second library.

According to another aspect of the invention, the method involves selecting a high pressure column module from a first library for coupling to a main heat exchanger module from a second library and for coupling to a low pressure column module from a third library. The first library contains different high pressure column modules, with each module having a first and second set of interface points, and each of the two sets of interface points has relative spatial coordinates that are substantially the same as every other high pressure column module in the first library. The second library contains different main heat exchanger modules, with each module having a third set of interface points with relative spatial coordinates that are substantially the same as every other main heat exchanger module in the second library, and the third set of interface points are designed for coupling to the first set of interface points on each of the high pressure column modules. This method further involves providing a third library containing different low pressure column modules, with each module having a fourth set of interface points with relative spatial coordinates that are substantially the same as every other low pressure column module in this library, and the fourth set of interface points are designed for coupling to the second set of interface points on each of the high pressure column modules.

Another aspect of the invention relates to a method of building an air separation plant based on a design obtained according to a design method. The design method involves selecting a main heat exchange module design and a high pressure column module design from two separate libraries, one of which contains different main heat exchanger module designs and the other contains different high pressure column module designs. Each of the different heat exchange module designs has a first set of predetermined interface points for connecting to a second set of predetermined interface points on each of the different high pressure column module designs, with the first set of predetermined interface points having the same relative spatial coordinates, and the second set of predetermined interface points having the same relative spatial coordinates.

Another aspect of the invention provides for an air separation unit having a first module with a first set of interface points coupled to a second set of interface points of a second module. The first module is selected from a first library containing different designs of the first module, with each of the different designs having at least some interface points that have substantially the same relative spatial coordinates as the first set of interface points. The second module is selected from a second library containing different designs of the second module, with each of the different designs having at least some interface points that have substantially the same relative spatial coordinates as the second set of interface points.

Yet another aspect of the invention provides for a library for use in designing an air separation unit, with the library containing at least two modules and each of the modules has substantially the same relative spatial coordinates of interface points as every other module in the library.

BRIEF DESCRIPTION OF THE DRAWINGS

While the specification concludes with claims distinctly pointing out the subject matter that the applicants regard as their invention, it is believed the invention would be better understood when taken in connection with the accompanying drawings in which:

DETAILED DESCRIPTION OF THE INVENTION

Figure 1:
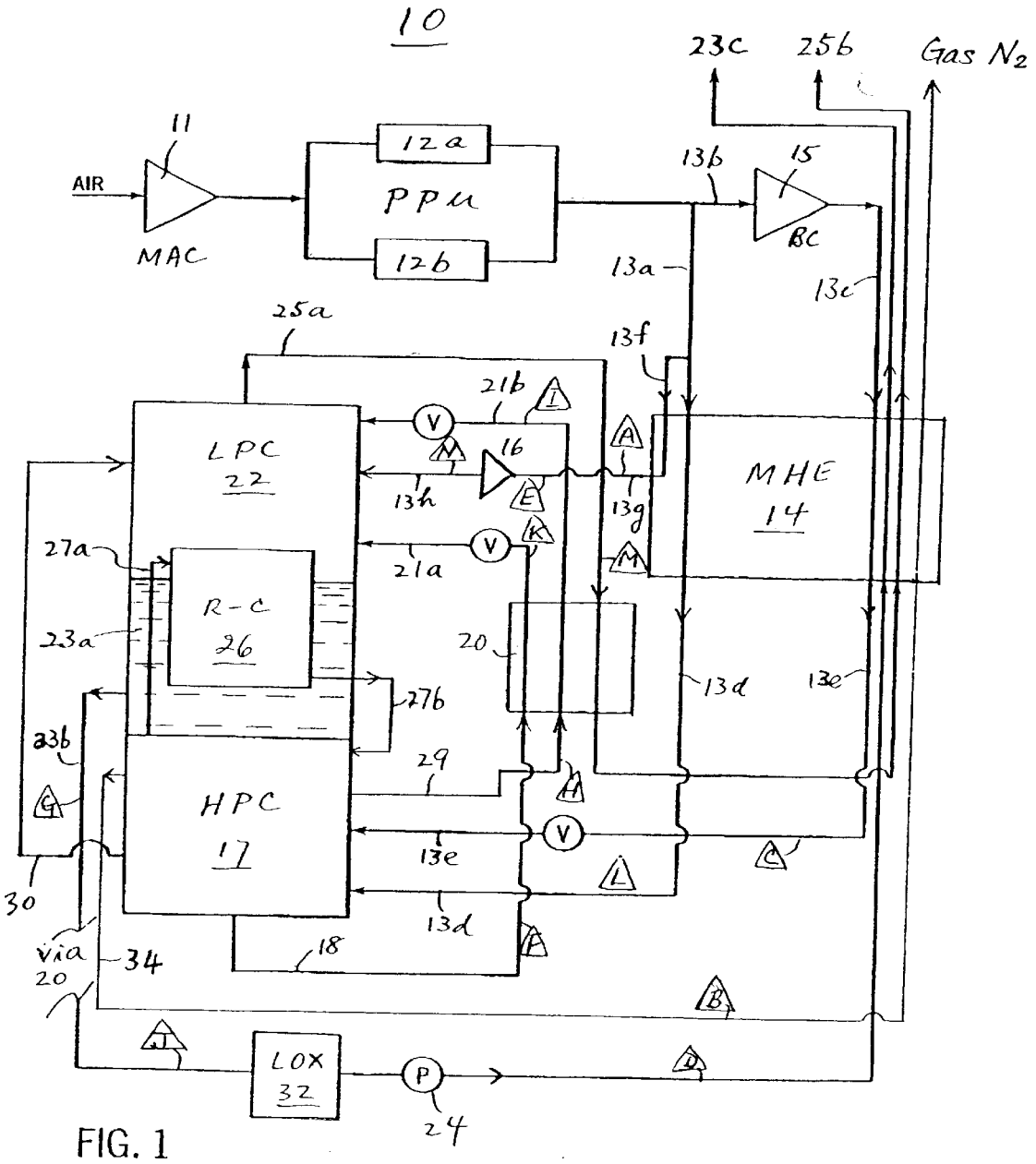
FIG. 1 is a schematic diagram of an air separation plant.

An air separation plant is an assembly of different "modules" performing, in operation, different functions associated with an air separation process. Thus, as previously described, an air separation plant typically includes an air compression module, an air pre-purification module, at least one heat exchange module, one or more rectification column modules, and at least one turbo-expander module. The air separation plant can be designed to produce a pure or impure oxygen product (or both), a pure or impure nitrogen product (or both), and optionally a pure or impure argon product.

In accordance with the present invention, the air separation plant is designed as follows. First, for each module in the air separation plant, particularly the heat exchange module and the rectification column modules, a plurality of different designs are made. The number of different designs of each module can be selected so as to cater to a wide range of different air flow rates into the plant, and/or to provide for different levels of thermodynamic operating efficiency (typically at different capital cost) for each selected air flow rate. Each design is made in essentially full external topographical detail and may consist of complete manufacturing drawings of the module concerned. The designs are kept for future use. A repository of designs of a particular module is referred to herein as a "library".

When an actual air separation plant needs to be designed, module designs can therefore be selected from the libraries according to the rate at which each product is to be produced (or the rate at which air is to be separated), the purity requirement of the products, and according to the balance to be struck between the capital cost and the power consumption of the plant. Typically, modules in the libraries have predetermined designs prior to the selection process. However, additional module designs that are not available in the existing libraries may also be generated as appropriate. Each module is then built and the modules are interconnected to form the plant. Usually, but not necessarily, the modules are built at a site or sites remote from the one where the plant is to be operated and are transported to the site of use, where they are interconnected.

In the assembled air separation plant, certain modules that perform one function have interfaces or connections with at least one other module that perform another function. Thus, for example, the high pressure column module has a plurality of interfaces with both the low pressure column module and the main heat exchanger module. In accordance with the invention, a plurality of designs of the same module have these interfaces at substantially the same predetermined spatial coordinates as one another or within predetermined loci. Thus, in assembling the plant, the relevant modules can be readily coupled together. For example, as will be further described below, a high pressure column module built according to any one of a number of different designs can be coupled to a main heat exchanger module and a low pressure column module, both built respectively according to any one of a number of different designs of each module. Whatever combination is selected, the interfaces between the respective modules are in substantially the same positions in the assembled plant. The need to have these interfaces in substantially the same positions regardless of which modules are selected is an important aspect in the design of these modules.

The method of design according to the invention can be extended beyond the rectification column and heat exchanger modules to other modules in the air separation plant.

As used herein, "module" means an assembly of components of an air separation unit, or a design representation thereof, that comprises at least three interface points. Each module is designed to be coupled, via its interface points, to at least one other module or equipment associated with the air separation unit. "Interface point" means a line end, e.g., a pipe end, of a module that delivers a fluid (gas or liquid), energy or information to a line or pipe end of another adjoining or otherwise connected module. Preferably, at least a majority of the key interface points of the modules of this invention are designed to connect directly or through relatively straight and short connectors to the corresponding interface points of an other module or other equipment associated with a cryogenic air separation unit. Other line ends include electrical connections, control instrumentation cabling and the like.

As used herein, "library of modules" means a set or collection of two or more like modules designed to perform substantially the same function but differing from one another in size, capacity and/or efficiency. The modules of the library may refer to the hardware, i.e., physically existing, or a design representation, e.g., a blueprint, design specifications, a CAD/CAM drawing stored in a computer memory or other storage device, etc. In one embodiment, the libraries comprise collections of designs stored on a computer from which the physical components are built as needed. In most cases, the modules in hardware or constructed form are not kept in inventory because most components are too large and/or expensive to simply build and store.

Each module in a given library has at least one set of interface points having substantially the same topography as each other, i.e., the spatial coordinates or layout of the interface points relative to one another within the set is substantially the same for each module of the library. This set of interface points is used for coupling to corresponding interface points in a module from a different library. For interface points having a relatively large "effective diameter", at least a majority, and preferably all, are designed to have the same topography for each module within a given library. This substantially fixed module interface point topography allows for a "plug-in/plug-out" feature of the modules. Other features commonly shared by modules within a given library include standardized component parts; interchangeability of various parts, e.g., gearing, bearings, and seals; a single, standardized layout with fixed location of customer interface coordinate locations.

As used herein, "effective diameter" means the cross-sectional length of the line end. If the cross-sectional shape of a line end is circular, then the cross-sectional length is a diameter. If the cross-sectional shape of the line end is a shape other than circular, e.g., oval, rectangular, etc., then the cross-sectional length is the longest length across the cross-section. Most line ends, particularly those with an effective diameter of four or more inches, are pipe ends with a circular cross-section.

Such large lines, e.g., pipes, are often difficult to configure within the limited space of a module and as such, the design of air separation units is greatly facilitated if the ends of these lines are designed to mate directly with those of an adjoining module, or at least can readily be coupled to the other module with relatively short or straight connectors. More preferably, interface points with a smaller effective diameter, e.g., less than about four inches, are also spatially fixed relative to the other line ends or interface points of the adjoining or otherwise connected module. However, since these smaller lines are easier to configure within the limited space of the module, the topography of these line ends need not be fixed to maintain the plug-in/plug-out feature of the modules. It is understood that the use of four inches as a reference for large versus small effective diameter is meant for illustrative purpose, and such a reference point may vary according to specific module designs and space constraints.

As used herein, "module size" or "module capacity" means the amount of fluid or energy that the module can process or transfer with a given period of time. For heat exchangers, pumps and the like, size or capacity is typically measured in units of volume per time. For steam heaters and the like, the typical units are BTUs/hour. For storage tanks, etc., volume units are used.

In order to provide a context for the module libraries of this invention, the basic component parts of an air separation plant are described first. Moreover, although the following description of the air separation plant is in the context of the manufacture of oxygen, nitrogen and argon, this is but one embodiment of the invention. Other air separation plant designs are possible as well as designs for other manufacturing plants that lend themselves to modularization, e.g., chemical manufacture, metallurgical operations, glass manufacture, etc.

Various aspects of the invention are described by reference to the drawings in which like numerals are employed to designate like parts and features. Although various items of equipment, such as fittings, mountings, pipes, and the like have been omitted to simplify the description, such conventional equipment can be employed as desired.

Figure 2:
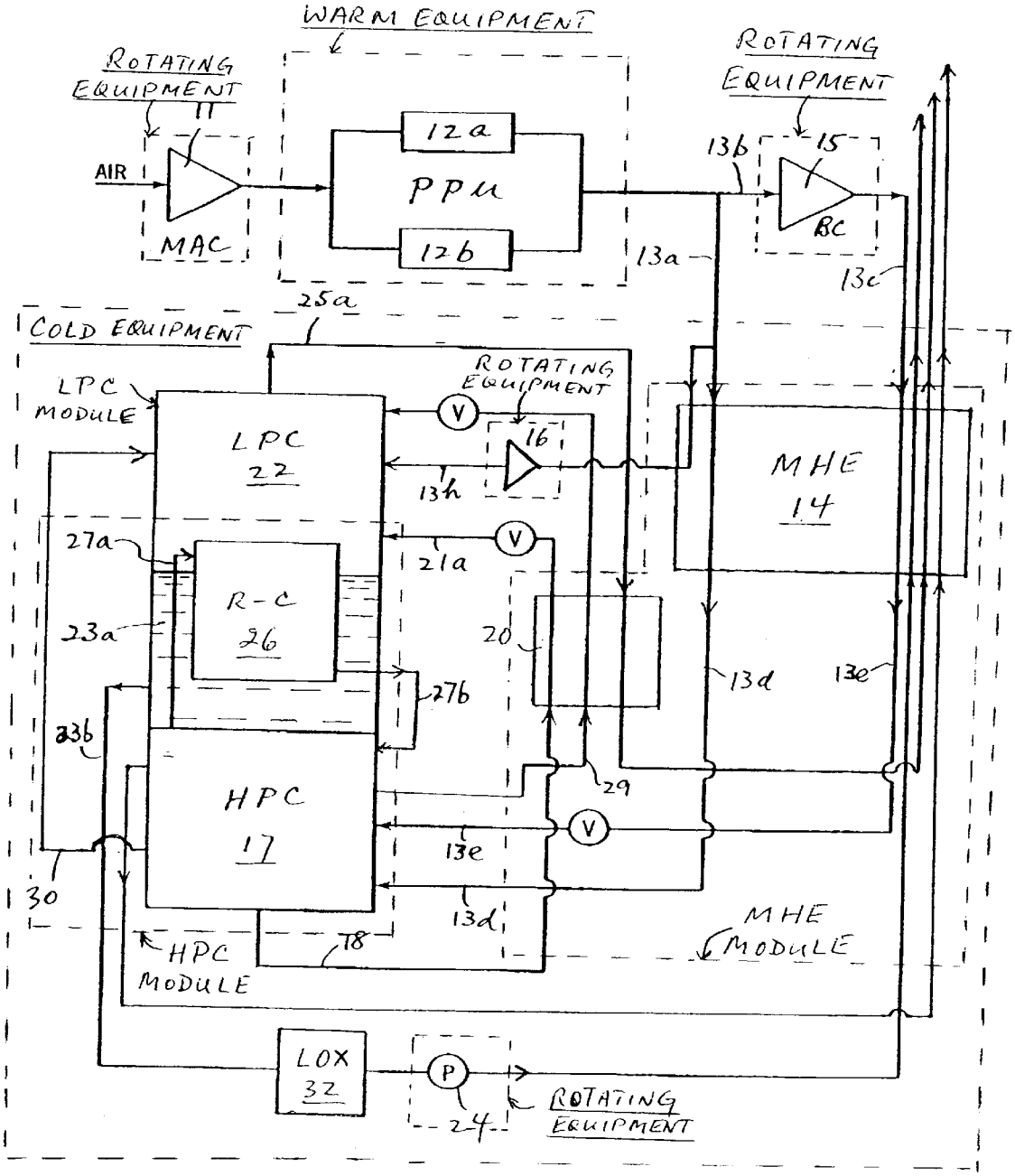
FIG. 2 is a schematic diagram of an air separation plant showing the rotating, warm and cold equipment subsystems.

An air separation plant may be described as comprising a number of subsystems, typically four subsystems, i.e., rotating equipment, warm equipment, cold equipment and site equipment. The first three of these subsystems are illustrated in FIG. 2. Each subsystem may or may not be constructed in such manner as to constitute a complete, integrated assembly. While the warm and cold subsystems tend to be complete, integrated structures, i.e., all of their individual modules are connected to one another in a single assemblage, the rotating and site equipment subsystems tend to be just the opposite. Two or more components of these latter two subsystems are usually separate and apart from one another. For example, the rotating equipment subsystem is likely to comprise at least two compressor modules and at least one expander module. The two compressor modules are likely to be placed in association with the warm equipment subsystem, e.g., the main air and the booster air compressors (MAC and BC) and neither module is necessarily connected to the other (although they often are), while the expander module is likely to be placed in the cold equipment subsystem (and not connected to either compressor module). This is illustrated in FIG. 2.

Moreover, the subsystems have an arbitrary element to their definition, i.e., the exact number and nature of modules that constitute a given subsystem can vary from one air separation plant to another. Typically, each subsystem comprises certain modules that define its operation and character. For example, the cold equipment subsystem (also known as a cold box) often comprise a main heat exchanger, a high pressure column and a low pressure column. In one air separation plant, the cold equipment subsystem may further comprise a subcooler and/or an argon column; while in another air separation plant, these items of equipment may be located in another subsystem. These differences are not important to the invention, and the concept of a subsystem is here used simply as an aid in describing the invention.

Rotating Equipment Subsystem

The function of the modules in the rotating equipment subsystem is to move the gas and/or liquid streams through the air separation plant. This movement includes regulating the pressure of these various streams. Examples of the modules in the rotating equipment subsystem include the following: (i) main air compressor, (ii) booster air compressor, (iii) inlet air filters, (iv) expansion turbine-generator brake, (v) expansion turbine-compressor brake, (vi) nitrogen product compressor, (vii) oxygen product compressor, and (viii) argon product compressor.

In designing an air separation plant, modules are selected from libraries comprising different designs of the respective modules. For example, a main air compressor module having a desired gas flow rate is selected from a library of main air compressor modules, while a booster air compressor module is selected from a library of booster air compressor modules, and so on. The size of each library can vary but for air separation units of 200–2000 MTPD, typically both the main and booster air compressor libraries may comprise six or more modules each, the inlet air filter library may comprise five or more modules each, both the expansion turbine-generator brake and compressor brake libraries may comprise three or more modules each, and the nitrogen, oxygen and argon compressor libraries may comprise two or more modules each. Typically the modules within each of these libraries differ from one another primarily in their respective gas flow rate capacities, and in some cases, also in the compression ratios.

Optionally, two or more rotating equipment subsystem modules may be combined to form a larger module, e.g., the main air and booster air compressor modules can be combined into a single compressor module. In this context, the term "module" is understood to also encompass combinations of two or more other modules, and such a combination module may be referred to as a "super module".

In one embodiment, the main air compressor is an integral gear-type, centrifugal compressor, typically with three stages. The compressor, along with drive motor, is supplied with inter-coolers, a lube oil system, inter-connecting piping (within the skid if the module is skid-mounted), and the instrumentation and controls required for machine protection. The discharge pressures of the main air compressor are typically between about 4.5 to about 7 bar absolute (bara).

The booster air compressor module is similar to the main air compressor module. The booster air compressor typically has 1 to 4 stages, and it is an integral gear-type, centrifugal machine. The module includes drive motors which are supplied with inter-coolers, an after cooler, a lube oil system, inter-connecting piping within the module skid, and instrumentation and controls required for machine protection. The discharge pressures of the booster air compressor range up to about 70 bar absolute.

The inlet filters are used with the main air compressor and constitute a separate module. The product compressor modules, i.e., the modules for the oxygen, nitrogen and argon product compressors, can be similar in design to the booster air compressor module. Alternatively, some of these compressors can be a screw machine type or a reciprocating compressor type. These additional type of compressors are readily known to anyone skilled in the art of industrial gas production.

The expander generator module, i.e., an expansion turbine connected to a generator brake to create work or energy that can be used within or sent without the plant, includes a high efficiency, radial-inflow type impeller design braked by a generator. These modules include the necessary instruments, manual and control valves, and like all of the modules within a given library, are available in different sizes. The expander compressor module, i.e., an expansion turbine connected to a compressor brake (which does not produce electrical work), is similar in design to the generator brake module, but it includes a compressor brake and an after-cooler arrangement. It also includes the necessary instruments, and manual and control valves. The modules of the rotating equipment subsystem are optionally, and typically, equipped with silencers, e.g., vent silencers, inline silencers, etc.

Warm Equipment Subsystem

The function of the warm equipment subsystem is to prepare the air stream for separation into two or more of its components. This function typically includes removing from the air certain components that are detrimental to the operation of the cold equipment subsystem, e.g., carbon dioxide, water, trace hydrocarbons and the like, and optionally, minor modification of the air stream temperature.

Examples of modules in the warm equipment subsystem include the following: (i) direct contact cooler, (ii) evaporative cooler, (iii) direct contact cooler pump, (iv) chilled water pump, (v) thermal swing adsorption pre-purification unit (TSA PPU), (vi) pressure swing adsorption pre-purification unit (PSA PPU), (vii) TSA PPU piping, (viii) PSA PPU piping, (ix) regeneration piping, (x) electric regeneration heater, (xi) gas-fired regeneration heater, and (xii) steam regeneration heater. As previously mentioned, a library comprises modules performing the same function. Thus, an air separation plant built or designed according to the present invention may comprise a direct contact cooler module selected from a library of direct contact cooler modules having different cooling capacities, or a TSA PPU piping module selected from a library of TSA PPU piping modules having different pipe dimensions or efficiencies, and so on.

The size of each library can vary but as an example, for air separation units having output capacities of 200–2000 MTPD, typically the chilled water pump library may comprise two or more modules; the direct contact cooler pump library may comprise three or more modules; the evaporative cooler and gas-fired regeneration heater libraries may comprise four or more modules each; the direct contact cooler and electric regeneration heater libraries may comprise five or more modules each; and the TSA PPU, PSA PPU, TSA PPU piping, PSA PPU piping, regeneration piping and steam regeneration libraries may comprise six or more modules each. The modules within each of these libraries differ from one another primarily by size, e.g., gas or liquid flow rate capacity, pipe diameter, and Btu/hr and kilowatt generation, although modules within certain libraries, e.g., the TSA PPU piping, PSA PPU piping and regenerative piping modules, may also differ by performance efficiency.

In one embodiment of the invention, two or more warm equipment subsystem modules are combined to form a larger or super module, e.g., the PSA PPU and PSA PPU piping modules can be combined into a single module.

The duty requirements of the warm equipment subsystem modules are driven by the feed air conditions, i.e., flow, pressure, temperature, and impurity levels. Flow rate varies with module size, but the other conditions are relatively independent of size. For a given flow rate, i.e., plant size, the feed pressure and temperature do not change significantly across product lines. Variations in the co-product slate may change the airflow, i.e., recovery changes, but will not significantly change the pressure and temperature requirements. As such, the modules are well standardized within their respective module libraries.

The direct contact cooler module comprises a vessel with all associated instruments and pipework. Water nozzles are piped down to a convenient elevation from the vessel for field tie-ins. The air outlet nozzle is also piped down to a convenient elevation for field tie-ins.

The typical evaporative cooler module comprises a vessel with all associated instruments, and this vessel is also insulated and equipped with water nozzles that are piped down to a convenient elevation for tie-ins.

The direct contact cooler pump module and chilled water pump are preferably completely skidded, and comprise pumps with motors, flow measurement and control, and manual and control valves.

The PPU vessel of the TSA-PPU module comprises absorbents, support grids, distributors and other necessary internals. The vessels are typically of standard diameter and comprise either vertical or horizontal vessels. The PSA-PPU module is of similar design to the TSA-PPU module.

The typical TSA-PPU piping module is of a skidded construction. The skid comprises all air/waste nitrogen piping along with valves and instruments for the PPU vessels. The piping skid also houses the PPU depressurization silencer. Depending upon the size of the plant, the piping skid also houses the PPU after-filter (if such a filter is included in the plant design). The piping modules of a given library differ from one another by pipe size, the pipe diameter within a library varying from about 10 to about 50 inches. The PSA-PPU piping module has design features similar to that of the TSA-PPU piping module. In those designs in which an after-filter is included, it is typically located on either the PPU piping skid or on a separate skid (with all inlet, outlet and by-pass valves).

The electric regeneration heater required for TSA-PPU's is a module that includes control panel, temperature controller and sheath temperature protection safety. Likewise, the gas-fire regeneration heater is also a module that includes control panel, temperature controller and temperature protection safety. The steam regeneration heater module is of conventional design.

Cold Equipment Subsystem

The function of the cold equipment subsystem is to separate air into two or more components, typically oxygen, nitrogen and argon, with the products being generated in vapor and/or liquid phase. The cold equipment subsystem comprises modules that operate at cryogenic temperatures, i.e., temperatures of less than about −100 C., excluding any turbo-expanders. Examples of these modules include the following: (i) main heat exchanger (MHE) module, (ii) high pressure column (HPC) module, (iii) low purity column module, (iv) high purity column module, (v) high purity argon producing module consisting of a low pressure column and a crude argon column, and (vi) supplemental argon module. The low purity column module, high purity column module and high purity argon producing modules all operate at pressures lower than that of the HPC, and can be generically called low pressure column (LPC) modules.

These modules are typically housed in a self-supported, structural steel box, commonly referred to as the "cold box", or a plurality of such boxes. The cold box design broadly features the following: Perlite™ insulation, welded construction (including end connections to eliminate potential leaks), valves designed to allow seat change without Perlite™ removal, nitrogen purged to eliminate ingress of air into the insulation, cold box inter-space pressure relieve device, Perlite™ loading and removal ports, access to valves from grade or platforms, and cold box piping of aluminum material with welded connections.

A cold equipment subsystem of the present invention may be designed, for example, by selecting a MHE module having a desired flow capacity or heat transfer efficiency from a library of MHE modules, selecting a HPC module having a desired flow capacity or separation efficiency from a library of HPC modules, and selecting a LPC module from a library of LPC modules for coupling to the HPC and/or MHE module, and so on.

In general, the number of libraries and the size of each library (i.e., number of modules) used for designing an air separation plant may vary, depending on the specific air separation plant or application. Typically, a library comprises at least two modules. For example, for air separation units with an output capacity of about 200–2000 MTPD, the MHE, low purity low pressure column, the high purity low pressure column, and high purity argon low pressure column libraries may comprise four or more modules; the HPC library may comprise ten or more modules. Within each library, the modules differ from one another primarily by size, e.g., mass flow rate capacity, but in some cases, may also differ by performance efficiency.

Typically, the MHE and HPC modules are always present in a cold equipment subsystem, while the LPC is also present in a two-column subsystem. For certain air separation applications, it may be desirable to provide a selection of module designs that are directed towards different product purity requirements. Thus, a low purity column or a high purity column module may be "pre-designed" to suit various purity needs by using appropriate combinations of high pressure column modules and low pressure column modules.

Furthermore, if an argon product is desired, then one or more additional rectification columns are provided for the separation of the argon product. Each argon column may be housed in its own thermally-insulated structure.

The configuration of the rectification columns, the cryogenic heat exchangers and the interconnecting pipework is at the heart of the successful practical realization of any proposed air separation process. As previously mentioned, even changes to a process which are trivial conceptually, for example, mere changes in the rate at which air is taken for separation and the rate at which resulting products are produced, can result in a plethora of physical alterations to the actual air separation plant. The design method according to the invention adopts the approach of defining the positions or loci of interface points between key modules of the air separation plant, particularly between the main heat exchanger and the high pressure column modules, and most preferably, also between the high pressure column and the low pressure column modules. Two main advantages arise.

First, it becomes possible to pre-design a range of high pressure column modules which are compatible with some or all members of a range of pre-designed main heat exchanger modules and some or all members of a range of pre-designed low pressure column modules. As a consequence, it becomes possible to rapidly create a family of different detailed plant designs all embodying the same basic process but incorporating physical differences necessary, for example, to cater to different air flows.

A second advantage is that by fixing the relative spatial coordinates of interface points or providing interface points at predetermined locations, it is found possible to keep to a minimum the actual physical differences between the pipework in different sized modules of the same kind. Thus, once a particular module of a given size has been designed, it becomes a relatively simple matter to produce a whole family of compatible designs of that module notwithstanding the fact that pipework in an air separation plant is often complex, not to say labyrinthine to the untutored eye.

The main heat exchanger module is typically available in multiple-core versions, e.g., 2–10 or more cores; the more cores, of course, the greater the capacity or efficiency of the module. The main heat exchanger module houses both the main heat exchanger and liquid subcooler, both with all associated piping and instruments. Alternatively, the subcooler may also constitute a module separate from the main heat exchanger module.

The high pressure column module comprises a high pressure column and a reboiler-condenser with all associated piping, valves, and instrumentation. When used in conjunction with another rectification column, this module acts as an air pre-separation system, in which one or more fluid streams, e.g., a nitrogen-enriched stream and an oxygen-enriched liquid stream, are produced for further processing in downstream column modules. The box of this module is designed to accommodate different diameter columns, and it may include a conical section that allows for mating with downstream columns of different diameters. In certain embodiments, a section can be added to the high pressure column to make co-product nitrogen.

The low pressure column modules comprise a low pressure column, all associated piping, valves, and instrumentation, and in some instances a supplemental argon side column. This module is used in conjunction with a high pressure column module—often in a close coupled mode, and provides for further processing of fluid streams generated from the high pressure column. Such a multiple column system provides a higher separation efficiency compared to a single-column system, and is suitable for generation of products such as oxygen, argon or high purity nitrogen. In the context of this invention, a high pressure column refers to a distillation column that operates at a pressure higher than that of the low pressure column. The pressure ranges for the high and low pressure columns may vary according to specific application needs and column designs.

Optionally, the reboiler-condenser may be designed as a separate module with respective sets of interface points for coupling to the high pressure column and the low pressure column modules. In another embodiment, the reboiler-condenser may also be incorporated as part of the low pressure column module by combining with a low pressure column.

The low purity column, high purity column, and high purity argon producing column modules are low pressure columns with all associated pipework and instrumentation. These modules differ in separation efficiency and capacity to meet different customer demands. In certain embodiments, these modules are independent modules that are close coupled to the high pressure column module. In other embodiments, the high pressure column module and one of these three column modules form a larger or super module.

The supplemental argon module comprises a distillation column, reboiler-condensers, and other heat transfer equipment with all associated piping, valves, and instrumentation for further purification of argon co-product. In certain embodiments, this module can be a stand alone system for argon purification. In other embodiments, these modules can be close coupled to the HPA column module.

Site Equipment Subsystem

The function of site equipment subsystem is to provide power to and to monitor the other subsystems, and to collect and store the products from the cold equipment subsystem. Examples of modules in the site equipment subsystem include the following: (i) cryogenic pump, (ii) vertical/horizontal storage tank, (iii) field erected storage tank, (iv) storage valve/piping, (v) ambient vaporizer, (vi) steam bath vaporizer, and (vii) fuel-fired vaporizer.

Each module is a member of a library of like modules, i.e., the cryogenic pump module is selected from a library of cryogenic pump modules, the vertical/horizontal storage tank module is selected from a library of vertical/horizontal storage tank modules, etc. The size of each library can vary but for air separation units with an output capacity of about 200–2000 MTPD, the cryogenic pump and ambient vaporizer libraries may comprise five or more modules each; the vertical/horizontal storage tank library may comprise three or more modules; the field-erected storage tank library may comprise six or more modules; the steam and fuel-fired vaporizer libraries may comprise four or more modules each; and the storage valve/piping library may comprise two or more modules. The modules within each of these libraries differ from one another primarily by size, e.g., gas or liquid flow rate capacity, pipe diameter, and Btu/hr and tank volume.

In one embodiment of the invention, two or more site equipment subsystem modules are combined to form a larger or super module, e.g., the vertical/horizontal storage and/or field-erected tank and storage valve/piping piping modules can be combined into a single module.

The cryogenic pump module typically contains one or two cryogenic pumps with drive motors along with the associated instruments, valves, piping and controls, and they are designed as a skidded package.

The vertical storage tank modules include all necessary instruments, pressure building coils and valves. The horizontal storage tank module and the field-erected (flat bottom) storage tank modules are similarly designed equipment. The piping and valve module for the tanks is provided as a separate skid to the extent that instrumentation, pressure-building coils and valves beyond those incorporated into the tank modules are desired. In these instances, the piping and valve module is coupled with the tank module.

The ambient vaporizer module is also typically skidded, and it too incorporates all the associated piping, valves and instruments. The water bath vaporizer module is similar to the ambient vaporizer module, and any available heat source can be used, e.g., liquid propane, natural gas, etc. The direct steam vapor module is also similar to the ambient vaporizer, and it too can use any available energy supply as the source of heat.

Method of Designing an ASU

In practicing the present invention, subsystems of an air separation unit are designed and built by selecting one or more modules and associated equipment from various module libraries. The selection of the individual modules will depend in large part on the desired performance specifications of the air separation unit. Typically, the choice of module, particularly the size of the module, is a function of the cost vs. power trade-off that is made for essentially each item of equipment to be included in the air separation unit.

Figure 3:
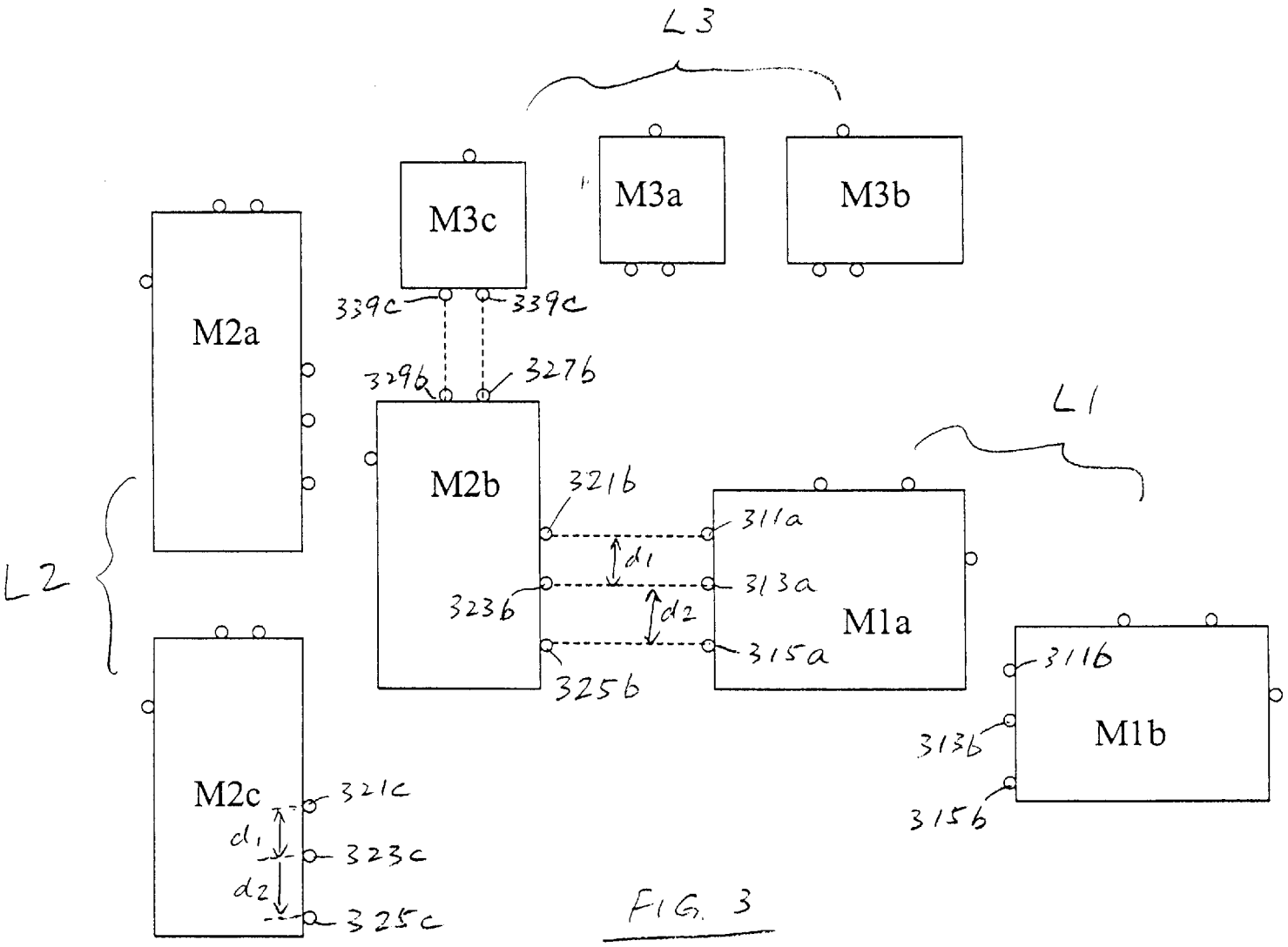
FIG. 3 is a schematic diagram illustrating the use of module libraries in designing an air separation plant according to the present invention.

FIG. 3 is a schematic diagram that further illustrates the concept of designing or building an air separation unit according to the present invention. The design method involves selecting specific modules from various libraries, e.g., L1, L2 and L3, each comprising different modules or component designs. For example, library L1 comprises modules M1*a* and M1*b*, which correspond to two different versions or designs of a module that performs a particular function. Similarly, library L2 comprises modules M2*a*, M2*b* and M2*c*, which are different designs of another module. In most cases, modules within each library differ from each other primarily by the module size or capacity, although in some cases, they may differ by performance efficiency.

As shown in FIG. 3, each module within the same library is characterized by at least three interface points for coupling to one or more modules from other libraries. For each module within the library, at least some of the interface points should have the same spatial layout as every other module in that library, regardless of the module design or size. For example, while modules M2*a*, M2*b* and M2*c* may have different gas flow capacities and/or physical sizes, each of these modules has the same topography for at least one or more subsets of interface points. In this illustration, interface points (321*b*, 323*b*, 325*b*) on module M2*b* have the same spatial relationship as interface points (321*c*, 323*c*, 325*c*) on module M2*c*—e.g., relative spatial coordinates d1 and d2 being the same, and likewise for the corresponding interface points on module M2*a*. As such, each module in library L2 can readily be coupled to corresponding interface points (311*a*, 313*a*, 315*a*) on module M1*a*; or those on module M1*b*, which also has the same topography of corresponding interface points as module M1*a*.

Furthermore, it is preferable that the topography of interface points (327*b*, 329*b*) of module M2*b* be the same as that of corresponding interface points on modules M2*a* and M2*c*, in order to facilitate the coupling of these modules to any of the modules in library L3. However, it is not necessary that the subset (321*b*, 323*b*, 325*b*) be maintained in a fixed spatial relationship with respect to the subset (327*b*, 329*b*). Since modules M2*b* and M2*c* may differ in their physical dimensions, it is possible that spacings between two subsets of interface points be different from module to module within the same library.

Thus, according to the present invention, each module in a given library is designed such that fixed relative spatial coordinates are maintained among at least a majority of interface points within individual subsets that couple to corresponding interface points of other modules. It is understood that the fixed relative spatial coordinates—i.e., same topography or layout of interface points, does not require a perfect spatial alignment of the interface points with respect to each other. Instead, a certain amount of tolerance, such as that within a predetermined range of spatial coordinates, is acceptable for the purpose of practicing the invention. The amount of tolerance or misalignment may vary for different modules according to specific coupling requirements and space constraints. For cryogenic modules in the cold equipment subsystem, the column modules, in particular, can essentially employ a common pipework design. Thus, the tolerance of the interface points should not be so large as to make the design principle difficult or impossible to implement. By providing standardization of interface points, modules in one library can readily be interchanged for coupling to other modules, resulting in considerable design flexibility according to specific application needs.

Certain modules are designed for close coupling with one another. In this case, each module is designed to have at least a majority, and preferably all, of the key interface points (e.g., pipe ends used for connecting to the other closed-coupled module) connect directly or through relatively straight and short connectors to corresponding interface points of the other module or equipment. For example, the expander modules (any size) are designed for close coupling with the main heat exchanger modules (any size). Likewise, the main heat exchanger modules (any size) are designed for close coupling with the high pressure column modules (any size). The interfacial connect points of modules designed for close coupling are the same despite the size differences within a module library, and this allows easy plug-in/plug-out connections to the adjoining module. Similarly, the high pressure column and low pressure column modules are designed for close coupling with one another as are the low pressure column and argon columns.

incoming main air, turbine air and boosted air streams to the exiting product oxygen, product nitrogen and waste nitrogen streams.

MHE module 60 connects to HPC module 61 via interface connections A-N as illustrated in Table 1. This table provides some examples of the interconnectivity between the high pressure column module and the heat exchange module in an air separation plant. These interface connections are also shown in FIG. 1 with the labels enclosed in triangles. (Note that FIG. 1 is meant to illustrate generally the fluid stream flows, but not the actual pipework connections between the modules.) Some of the components listed in Table 1 are conduits through a module to provide a fluid to a downstream module. For example, for interface connection I, the HPC module component is the conduit pipework and valve that transmits the poor liquid from the MHE module to the LPC module.

TABLE 1

MHE Module and HPC Module Interface Points

| Interface | | From | | To | |
|---|---|---|---|---|---|
| Connection | Service | Module | Component | Module | Component |
| A | Turbine Air Stream | MHE | Main Exchanger | HPC | Turbine pipework stress loop |
| B | Gaseous Product $N_2$ | HPC | High-pressure column | MHE | Main Exchanger |
| C | Boosted air Stream | MHE | Main Exchanger | HPC | High-pressure column |
| D | Gaseous $O_2$ product | HPC | Liquid $O_2$ pump module | MHE | Main exchanger |
| E | Turbine Air Stream | HPC | Turbine pipework stress loop | MHE | Pass through pipework to turbine module |
| F | Rich liquid stream | HPC | High-pressure column | MHE | Subcooler |
| G | Liquid $O_2$ stream | HPC | High-pressure column | MHE | Subcooler |
| H | Poor liquid stream | HPC | High-pressure column | MHE | Subcooler |
| I | Poor liquid stream | MHE | Subcooler | HPC | Pass through pipework to LPC module |
| J | Liquid $O_2$ stream | MHE | Subcooler | HPC | Pass through to pipework liquid $O_2$ storage module |
| K | Rich liquid stream | MHE | Subcooler | HPC | Pass through pipework to LPC module |
| L | Main Air | MHE | Main Exchanger | HPC | High-pressure column |
| M | Waste Nitrogen | HPC | Pass through pipework from LPC module | MHE | Subcooler |
| N | Expander Exhaust | MHE | Pass through pipework | HPC | High-pressure column |

For modules that are not close-coupled, more flexibility is available for the interconnecting pipework. However, it is still advantageous to have fixed interface point topography for these modules because the predetermined interface point locations can greatly facilitate the layout of these interconnecting pipework.

Figure 4:
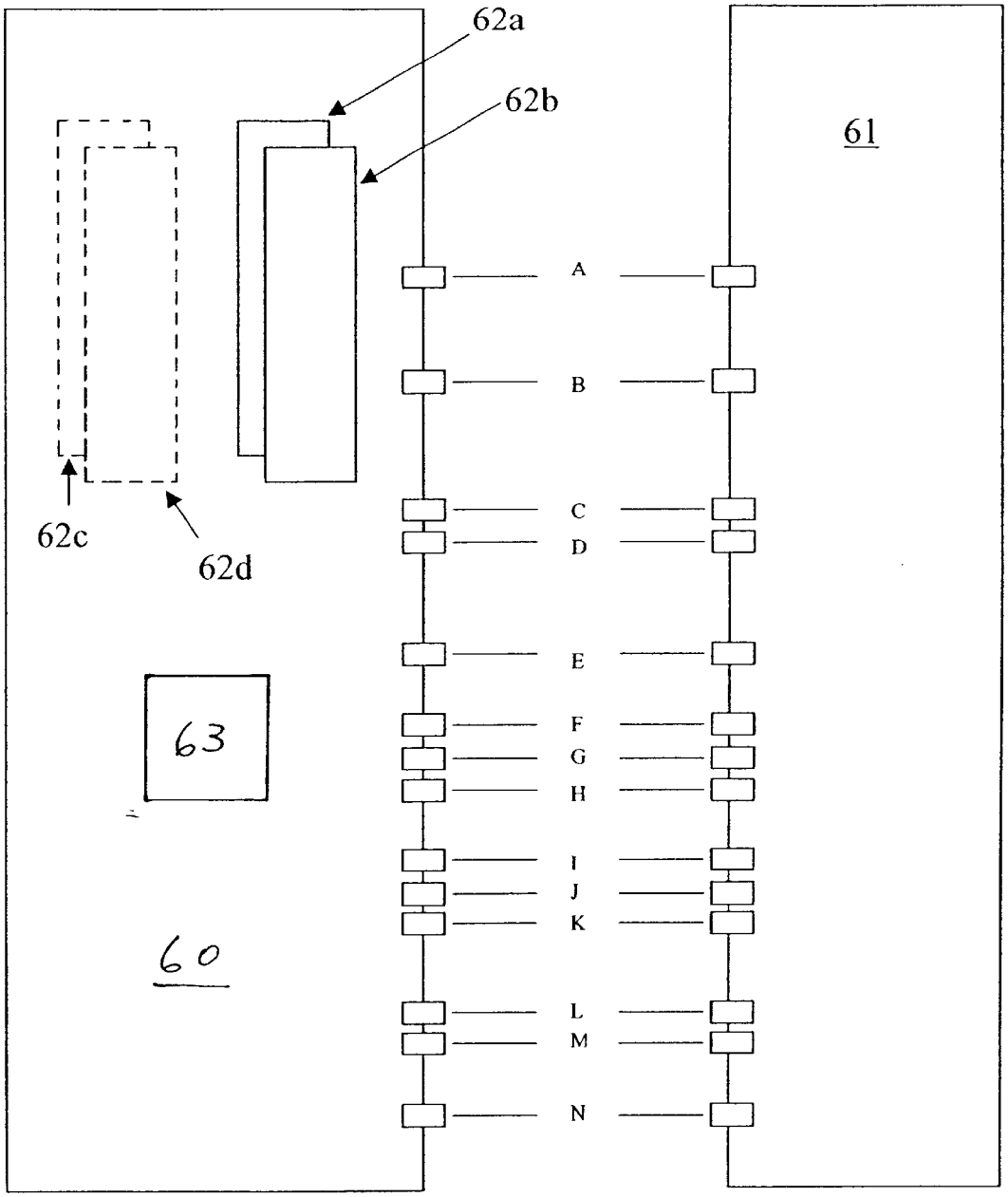
FIG. 4 is a schematic view of a two- and four-core main heat exchanger in combination with a high pressure column. Two of the cores of the four-core main heat exchanger are shown in a phantom format.

The interface points of two modules are illustrated in FIG. 4, which is a schematic diagram showing a two-core or four-core MHE module 60 in combination with HPC module 61. The two-core MHE module comprises main heat exchangers 62*a–b* (the four-core MHE comprises exchangers 62*a–d* with exchangers 62*c–d* shown in phantom format) and subcooler 63 for the main heat transfer requirements for the air separation plant. This module transfers heat from the The only material difference between the two-core MHE module and the four-core MHE module is that the latter has twice the processing capacity as the former. In other words, both the two-core and four-core MHE modules are members of the same MHE module library, and they differ from one another principally in size. In this embodiment, the interface points of both the two-core and four-core MHE modules—i.e., those used for connecting to the HPC module via connections A-N, have the same spatial relationship with the corresponding interface points of the HPC module. Although interface points corresponding to smaller pipe diameters are allowed certain degree of flexibility, it is preferable that they also maintain fixed relative spatial coordinates for each of the modules. In general, the positioning of electrical connections or cabling are allowed a greater degree of flexibility, and does not have to be subjected to similar spatial constraints as for pipeworks for fluid streams. Maintaining this same spatial relationship allows for the "plug in/plug-out" character of these modules that provides for considerable design flexibility.

The connectors that join the interface points of the MHE and HPC interface points to one another are typically a short, e.g., between about 2 and about 4 feet, relatively straight length of pipe, the ends of which mate with the corresponding interface points of the two close-coupled modules. These connectors are typically pipe spool pieces, and they may also include reducers, which allow coupling between pipe ends of different diameters. The connectors are joined to the interface points of the close-coupled modules in any convenient manner that results in a gas- and liquid-tight seal under operating conditions, e.g., welding.

The placement or spatial relationship between the interface points on any given module may vary to design. The placement of the interface points relative to one another on the modules illustrated in the FIG. 4 is exemplary. While the spatial relationship of the interface points on any particular module, by itself, is not critical to the practice of this invention, the spatial relationship of interface points between two modules is important, particularly those designed for close coupling. One goal in the placement of the interface points on two modules designed for close coupling is to maximize the total number of interface points of adjoining modules so that the points will align opposite one another, especially for interface points with a relatively large effective diameter, e.g., more than about four inches. This results in the largest number of the most linear and shortest connectors. These interface placements are chosen with the consideration that these placements work for all modules of a given library, e.g., two-and four-core MHEs to an HPC module. Other considerations in determining the placement of interface points include hydraulic requirements, thermal stress, supportability, code requirements, pressure drops, thermal insulation, maintenance, minimizing leaks, minimizing costs and insulation requirements.

In one embodiment of this invention, the individual modules are enclosed within a frame. The design of the frame can vary widely, but the ultimate design is typically an amalgam of considerations relating to construction, shipping and protection. The frames are constructed of any material that will provide for these considerations, e.g., steel, and preferably the frames are designed to minimize their weight and space contribution to the module as a whole. Each module frame is designed to accommodate close coupling to another module, and typically the interface points of any given module are within the volume of the module defined by the frame.

The selection decisions necessary to configure an optimal plant solution are of two related but different types, i.e., size-related module selections and performance-related module selections. Depending on the functions of the modules, different libraries may comprise different number of modules of varying ranges of size or capacity. For example, the main air compressor module may require six different sizes to cover a range of plant sizes from 200–2,000 MTPD, while the booster air compressor module may require ten different sizes to cover the same range. Moreover, not all size ranges within a library of modules are necessarily equal, e.g., of the ten booster air compressor module sizes to cover a 200–2,000 MTPD plant capacity range, one module size may cover a range twice the size of another module. Some module sizes will overlap with respect to matching up with a module of a given size but of another function, e.g., two or more booster air compressor modules may be available for matching with one a given main air compressor module.

Capacity constraints exist for some modules while not for other modules. Capacity constraints exist for compressor modules (maximum air throughput), column modules (hydraulic limits, i.e., flooding), adsorbers (hydraulic limits, i.e., fluidization), and expanders (maximum air throughput). The ultimate choice of any particular module is determined by the ultimate plant capacity and the project specifications and performance requirement for a particular application.

Specific capacity constraints do not exist for other modules, e.g., the piping and valve skids, and the heat exchanger modules. Instead, selection of these modules is based on process flow sheet parameters, and a trade-off between power consumption and capital cost, i.e., pressure drop versus size. In other words, a larger size means a high capital cost for building the plant and a high pressure drop means high power consumption in operating the plant. However, since larger size also means less pressure drop, power savings in this case comes at the cost of high capital, and vice versa. In large part, selection of these modules is dependent upon the type and amount of co-products that the plant is designed to produce and for a given set of co-products, the actual solution to the plant design will depend upon the size of related matching modules.

Performance related module selections are also enabled by the interchangeability of the modules, i.e., the "plug-in/plug-out" feature of the modules. Most performance related module selections are centered on the refrigeration system of the plant, e.g., the main heat exchange modules (more cores mean higher capital cost and lower operational power requirements) and the expander (compressor brake versus generator brake). Performance related process options also exist and are centered on the refrigeration system of the plant, e.g., for a high liquid oxygen co-product, use an expander flow from the booster air compressor; for a high power, no co-product solution, use an expander flow from the main air compressor.

As previously mentioned, in one embodiment, libraries of module designs are stored in a memory device or computer-readable medium. An air separation unit, or subsystems thereof, may be designed by retrieving these module designs from the storage device, and selecting different modules from respective libraries. Such selection decisions may be based on constraints related to capacity, performance characteristics, process parameters, and other criteria such as power consumption and capital cost, among others. By providing different module designs in each library to cover desired ranges of capacity and performance characteristics, different configurations of the air separation unit can readily be designed and optimized to suit a wide variety of application needs according to different performance specification or criteria. Such a design method may optionally be implemented on a computer.

Although the invention has been described in considerable detail through the proceeding examples, this detail is for the purpose of illustration. Those skilled in the art will recognize that many variations and modifications can be made without departing from the spirit and scope of the invention as described in the appended claims.

What is claimed is:

1. A method of designing an air separation unit, the method comprising:

selecting a first module from a first library containing at least two different designs of said first module, selecting a second module from a second module library containing at least two different designs of said second module, wherein each of said module designs in said first library comprises a first set of interface points with substantially the same relative spatial coordinates as every other design in said first library, and each of said module designs in said second library comprises a second set of interface points with substantially the same relative spatial coordinates as every other design in said second library.

2. The method of claim 1, wherein said first module is a high pressure column module and said second module is a main heat exchanger module or a low pressure column module, and said first set of interface points of said high pressure column module is designed for coupling to said second set of interface points of said second module.

3. The method of claim 1, wherein said first module is a high pressure column module, said second module is a main heat exchanger module, each of said high pressure column module designs further comprises a third set of interface points for coupling to a low pressure column module, and said third set of interface points has substantially the same relative spatial coordinates for each of said different high pressure column module designs.

4. The method of claim 3, wherein said first set of interface points comprises at least an inlet for an air stream, said third set of interface points comprises an outlet for a first liquid stream and an outlet for a second liquid stream, said first liquid stream having a higher oxygen concentration than said second liquid stream.

5. The method of claim 4, wherein said second set of interface points of said main heat exchanger module comprises two outlets for two air streams at cryogenic temperatures and two inlets for receiving a liquid oxygen stream and a gaseous nitrogen stream.

6. The method of claim 5, wherein said low pressure column module is selected from a third library containing at least two different low pressure column module designs, each of said module designs in said third library comprising a fourth set of interface points for coupling to said third set of interface points of each of said high pressure column module designs.

7. The method of claim 1, wherein said first and second modules are selected from said first and second libraries according to criteria of power consumption and capital cost for said air separation unit.

8. The method of claim 7, wherein said first and second libraries are stored in a computer-readable medium, and said method is implemented on a computer containing a set of instructions for retrieving said first and second libraries from said computer-readable medium and selecting said first and second modules having capacity and performance characteristics that satisfy said criteria.

9. A method of designing an air separation unit, the method comprising:

providing a first library containing different high pressure column modules, each of said high pressure column modules having a first set of interface points and a second set of interface points, each of said first and second sets of interface points having relative spatial coordinates that are substantially the same as every other high pressure column module in said first library;

providing a second library containing different main heat exchanger modules, each main heat exchanger module having a third set of interface points with relative spatial coordinates that are substantially the same as every other main heat exchanger module in said second library, wherein said third set of interface points are designed for coupling to said first set of interface points on each of said high pressure column modules;

providing a third library containing different low pressure column modules, each low pressure column module having a fourth set of interface points with relative spatial coordinates that are substantially the same as every other low pressure column module in said third library, wherein said fourth set of interface points are designed for coupling to said second set of interface points on each of said high pressure column modules;

selecting a high pressure column module from said first library for coupling to a main heat exchanger module from said second library and for coupling to a low pressure column module from said third library.

10. A method of building an air separation plant comprising:

providing a design of said air separation plant according to a design method;

building said air separation plant based on said design;

said design method comprises:

providing a library of different main heat exchanger module designs and a library of different high pressure column module designs;

selecting a main heat exchange module design and a high pressure column module design from said libraries;

wherein each of said different heat exchange module designs has a first set of predetermined interface points for connecting to a second set of predetermined interface points on each of said different high pressure column module designs, said first set of predetermined interface points having the same relative spatial coordinates, and said second set of predetermined interface points having the same relative spatial coordinates.

11. An air separation unit comprising:

a first module having a first set of interface points coupled to a second set of interface points of a second module;

wherein said first module is selected from a first library containing different designs of said first module and said second module is selected from a second library containing different designs of said second module, each of said modules in said first library having at least some interface points with substantially the same relative spatial coordinates as said first set of interface points and each of said modules in said second library having at least some interface points with substantially the same relative spatial coordinates as said second set of interface points.

12. The air separation unit of claim 11, wherein said first module is a high pressure column module and said second module is a main heat exchanger module or a low pressure column module.

13. The air separation unit of claim 12, wherein each of said high pressure column modules in said first library comprises a high pressure column and a reboiler-condenser.

14. The air separation unit of claim 11, wherein said first module is a high pressure column module, said second module is a main heat exchanger module, and said high pressure column module is further coupled to a low pressure column module selected from a third library comprising different low pressure column module designs, each of said low pressure column module designs having a third set of interface points with substantially the same relative spatial coordinates for coupling with said high pressure column module.

15. A library for designing an air separation unit, said library comprising each collection including at least two collection modules wherein the modules of one collection perform a function different from a module, in another collection each module having substantially the same relative spatial coordinates of interface points as every other module in said collection.

16. The library of claim 15, wherein said two modules are two main heat exchange modules, two high pressure column modules or two low pressure column modules.

17. The library of claim 16, wherein each of said modules has at least three interface points.

18. The library of claim 15, wherein said two modules are two main heat exchange modules, and each of said two main heat exchange modules comprises interface points for: (i) turbine air stream, (ii) gaseous nitrogen stream, (iii) high pressure liquid air, and (iv) liquid oxygen stream.

* * * * *